United States Patent [19]

Matsui et al.

[11] 4,197,495

[45] Apr. 8, 1980

[54] SYSTEM FOR CONTROLLING THE CHARGE DISTRIBUTION AND FLOW IN BLAST FURNACE OPERATIONS USING MAGNETIC SENSORS POSITIONED WITHIN THE CHARGE

[75] Inventors: Masaaki Matsui; Kenji Tamura, both of Sakai; Yooichi Hayashi, Takaishi; Yoshihiro Fujii, Sakai; Yoshikatu Sigematu, Kawachinagano, all of Japan

[73] Assignee: Nippon Steel Corporation, Tokyo, Japan

[21] Appl. No.: 743,908

[22] Filed: Nov. 22, 1976

[30] Foreign Application Priority Data

Jul. 9, 1976 [JP] Japan ..... 51-81587

[51] Int. Cl.[2] ..... G01B 7/00; C21B 7/24

[52] U.S. Cl. ..... 324/207; 266/92

[58] Field of Search ..... 324/207, 208; 266/90, 266/92, 93; 75/41, 60

[56] References Cited

U.S. PATENT DOCUMENTS

| | | | |
|---|---|---|---|
| 3,581,070 | 5/1971 | Tsujihata et al. | 75/41 |
| 3,588,067 | 6/1971 | Shimotsuma et al. | 266/92 |

FOREIGN PATENT DOCUMENTS

| | | | |
|---|---|---|---|
| 1293177 | 4/1969 | Fed. Rep. of Germany | 75/41 |
| 2655297 | 9/1977 | Fed. Rep. of Germany | 266/92 |
| 48-3570 | 1/1973 | Japan | 324/208 |

OTHER PUBLICATIONS

Johnson, Paul D., Operating Experience with Nuclear Ray Blast Furnace Stock Gauge; Iron & Steel Eng.; Aug. 1960, pp. 168–169.

*Primary Examiner*—Robert J. Corcoran

[57] ABSTRACT

A furnace operation system, comprising, a plurality of hollow tubes arranged in place at a position lower than the raw material charging level in the furnace, and running through the body of the furnace, said hollow tubes being arranged in place into a multi-stage shape; a plurality of magnetic sensors arranged for each and every one of a designated number of measuring points selected in a manner of corresponding to the hollow tubes in the vertical direction, within the interior of the plurality of hollow tubes; and a means electrically connected with the plurality of magnetic sensors, which conducts processing of said signals from the said magnetic sensors which are obtained in correspondence to the downward movement of the charge fed into the furnace.

22 Claims, 20 Drawing Figures

SYSTEM FOR CONTROLLING THE CHARGE DISTRIBUTION AND FLOW IN BLAST FURNACE OPERATIONS USING MAGNETIC SENSORS POSITIONED WITHIN THE CHARGE

BACKGROUND OF THE INVENTION

The present invention relates to an operation system for a furnace such as a blast furnace, a shaft furnace, or the like.

A blast furnace is a gigantic, hermetically sealed, high-temperature reaction furnace covered with a thick layer of a refractory substance. It is quite difficult to grasp the behavior of the charges and the gases in the furnace in a correct and accurate manner. However, for the purpose of effecting the improvement of the productivity of the furnace and the quality of pig iron, it is imperative that the conditions in the furnace (hereinafter referred to as the furnace conditions) be maintained and controlled in a proper and stabilized manner. Here, the conditions in the furnace, generally expressed by the terms of the furnace conditions, will be classified into the shape of more concrete phenomena, and the mutual relations among them, also the positions thereof in the operation of a blast furnace will be described in a comprehensive manner.

Generally, the furnace conditions are roughly classified into air-permeable conditions in the furnace and furnace thermal states. The former, or the air-permeable conditions, are further subdivided into the following categories.

(i) Air-permeability in a narrow sense, which is grasped in terms of the gas pressure loss in the furnace or the fluctuations in the blast pressure;

(ii) Conditions of the downward movement of the charges, which is grasped in terms of the state of taking shape of such defective downward movement of the charges as hanging, slip, or the like; and (iii) The gas flow distribution in the direction of the radius of the furnace, distribution of the velocity of the downward movement of the charges, and distribution of the thickness of the layer.

The latter, or the furnace thermal states, are further subdivided into distribution of the temperature in the direction of the height of the furnace and distribution of the temperature in the direction of the diameter of the furnace.

Especially, the temperature in the directly reducing zone at the lower portion of the furnace (that is to say, the level of the furnace thermal state, the pig iron melting temperature); the level of the concentration of Si contained in pig iron and the state of the fluctuations therein; the temperature of the body of the furnace, including the shaft section and the like; and the state of the temperature of the gas at the top of the furnace, constitute the key items of the furnace thermal state among others. Furthermore, the composition of the gas at the top of the furnace, including, for instance, CO, $CO_2$, $H_2$ and $N_2$, whereupon the conditions of reduction of ore at the shaft section and the lower portion of the furnace are calculated, is also included as one of the key items of the furnace thermal state, since the said conditions constitute such items which influence the level of, especially, the endotherm attending upon the directly reducing reaction.

Next, described below will be as to the conditions of the permeability and the thermal state, especially the interrelation between these and the role thereof to be occupied in the operation of a blast furnace.

First, the conditions of the permeability are virtually determined by the physical properties of the charges to be charged into the blast furnace and the conditions of filling in the blast furnace. For instance, in case the particle size distribution of the coke, the ore, and the like constituting the charges (especially, the ratio of mixing of finely divided particles or finely divided powder) should extend (spread out), or the strength thereof should decrease, the permeability in the furnace is deteriorated. Therefore, to cope with such a situation, a countermeasure is employed of such a category that sieving is emphatically conducted prior to charging, to thus effectuate proper prevention of finely divided powder from being mixed into the furnace as much as practicable. Furthermore, control of the strength of coke and ore is carried out in a rigid manner, whereby such deterioration in permeability as is attributable to the physical properties of the charges has recently come to be reduced. Rather, the behavior of filling the charges into the furnace has come to carry considerable weight for the operation of a blast furnace. To put it otherwise, the conditions of the distribution of the thickness of the layers of coke and ore, the pattern of the shapes thereof (which is otherwise termed distribution of charges), and the conditions of the distribution of the velocity of descent, in the direction of the radius of the filling layers in the furnace, have come to be learned to the effect of exercising a considerable influence over the conditions of permeability and the furnace thermal state. Because coke is larger than ore in terms of the means particle diameter, their results in the reducing a great deal the resistance to permeation. Furthermore, while ore is subjected to softening and fusing in a high-temperature range of 1,000° C. or over, to thus form a fused layer featuring a high level of resistance to permeation, coke, or the part thereof, maintains a virtually solid state in the furnace, except such a case wherein coke is subjected to combustion and extinction in the combustion zone arranged before the tuyere of the furnace. For this reason, the permeability in the furnace may well be considered as to be determined by the conditions of filling the furnace with coke (to put it otherwise, distribution of the thickness of the layer of coke in the radial direction of the filling layers in the furnace or in the direction of the height of the furnace).

Now, in the case of the operation of a blast furnace, it is a conventional practice that coke and ore are charged into the shape of lamellar layers. Distribution of the thickness of the coke layer and distribution of the thickness of the ore layer have a close and inseparable relation with each other. Therefore, it is quite important to grasp the state of the both in the filling layers thereof, and to effectuate the control thereof in a proper manner. Furthermore, for the purpose of ensuring favorable permeability, it is recommendable that the thickness of the coke layer in the vicinity of the center of the furnace be increased, and that the thickness of the coke layer to be charged each time to be increased, to thus enable the gas to run through the coke layer readily enough.

However, in case the gas is so caused as to run through the coke layer in the furnace up to an excessive level, with too much emphasis placed on the permeability, to the contrary, the reaction of contact of ore with CO and $H_2$ in the indirectly reducing zone area in the top portion of the furnace is subjected to reduction. As a result thereof, the reduction efficiency of ore is decreased, until the direct reduction constituting a remarkable endothermic reaction is increased, thus resulting in a shortage in furnace heating. In such a case as this, now that the thickness of the ore layer in the vicinity of the furnace wall or in the intermittent portion in the radial direction is increased, such a situation results in decreasing the calorific value required for fusing to be effectuated at the time a thick layer of ore comes descending down to a position immediately above the combustion zone of the tuyere, hence an increase in the fusing load, until such might possibly lead to the deterioration in the conditions of the furnace by cooling or the like.

Besides, in case the thickness of the ore layer in the vicinity of the furnace wall is decreased, and the thickness of the coke layer in the said vicinity is increased, the fusing load in the combustion zone at the tuyere is alleviated. However, in this case, the flow of the gases is increased in the vicinity of the furnace wall, to the contrary. For this reason, an increase in the damage of the body of the furnace by gas attack, or an increase in frequency of coming-off of the adherend to the furnace wall, is thus caused to entail. Such might possibly constitute a cause of increasing the fluctuations in furnace heating in some case.

As set forth in the preceding paragraphs, the behavior of filling coke and ore in the filling layers in the furnace (especially, distribution of the thickness of the layers of the charges in the direction of the diameter of the furnace or in the direction of the height of the furnace) exercises a profound influence over the conditions of permeability and the conditions of furnace heating of a blast furnace (to put it otherwise, the conditions of a blast furnace). Therefore, the said items constitute important items of the object of control in the execution of the operation of a blast furnace.

However, now that a blast furnace is such a gigantic high-temperature reaction furnace as is covered with a thick layer of proper refractory, it is quite difficult to effectuate infallible detection of the behavior of the charges in the filling layer in the furnace. Such a means as proves effective enough for detecting in a direct manner the behavior of the charges in the direction of the diameter of the furnace or in the direction of the height of the furnace has thus far remained to be developed. For this reason, the only method employed for this purpose has been such an indirect one as simply serves for drawing an analogical inference. For instance, with regard to the distribution of the charges, such an attempt as is specifically designed for the purpose of detecting the distribution and the shape of the surface of the charges at the top of the furnace, wherein the head of a chain or a wire is caused to descend to the surface of the charges immediately following the charging thereof, to thus measure the depth of charging from the standard line, and the distribution of the thickness of the layers of the charges is to be detected, by taking the balance between the measured value thus obtained and the measured value obtained likewise at a time subsequent to charging as a criterion thereof. To add up thereto, such a method as is specifically contrived for measuring the distribution and the shape of the surface of the charges from the top of the furnace, by making use of a microwave, has been also introduced. However, it has been thus far confirmed through a series of model experiments, that the distribution and the shape of the charges immediately following the charging are subjected to fluctuations in the filling layers up to a fairly high level, due mainly to the disparity in the property values of the ore and the coke to be charged into the furnace from the top thereof and that in the momentum of the ore and the coke at the time of charging thereof.

The reason why the distribution and the shape at the time of charging and the distribution and the shape in the filling layers are in disparity in such a manner as is set forth above is assumed to rest with the undermentioned factors. To put it in concrete terms, now that the angle of repose of coke is larger than that of ore, the distribution and the shape immediately following the charging are rather larger in terms of the angle of inclination at the time of the charging of coke than at the time of the charging of ore. However, in the case of the charging of coke, followed by the charging of ore at the subsequent stage, the momentum of the ore at the time of the charging thereof is larger than that of the coke by as much as three to four times. For this reason, the impact force thereof so functions as to push the layer of the coke charged immediately prior thereto in the direction of the center of the furnace or in the direction of the furnace wall. As a result thereof, the distribution and the shape of the layer of the coke, as a whole, assumes a flat shape. To put it otherwise, the angle of inclination of the coke in the furnace becomes smaller than that of the ore. Thus, the distribution and the shape of the coke immediately charged at the time of the charging of the ore becomes fairly disparate from the distribution and the shape of the coke at the time of the charging thereof. Furthermore, pointed out as another factor of reducing the angle of inclination of the coke is such that the bulk specific gravity of coke is so light as to be approximately 0.5, while the bulk specific gravity of ore is approximately 2, wherefrom coke is prone to be pushed upward by virtue of such lifting power as is given birth by gases rising upward from below in the course of the operation. In view of the above-mentioned reasons, it must be considered that the actual distribution of the thickness of the layer in the charge filling layer in the furnace has thus been already subjected to fluctuations up to a fairly high level, even in case the shape of the surface of the charges before and after the charging of coke and that of the charges before and after the charing of ore are measured, respectively, and the distribution of the thickness of the layers, including the layer of the coke and the layer of the ore, in the radial direction is found on the basis of the balance of the charging depth between the both.

There has also been introduced a method wherein a magnetometer is fitted in place in the vicinity of the furnace wall or the internal furnace wall, to thus detect the behavior of the charges present in the vicinity of the furnace wall. However, such a method as this one is incapable of detecting but the behavior of the charges within the range of approximately a few score centimeters at best in terms of the distance apart from the internal wall of the furnace. For this reason, it cannot but say that the detection of the behavior of the charges in the direction of the diameter of the furnace within such a blast furnace whereof the inner diameter is 10 m or even more, like a gigantic blast furnace of the latest design, is far beyond practicability at all.

By the way, besides the above-mentioned attempt of directly detecting the behavior of the charges, there has also been introduced a method wherein a horizontal sonde is inserted in place or laid over in the direction of the diameter of the furnace at the top portion of the furnace, to thus conduct measurement of the distribution of the temperature or the distribution of the composition of gases. Furthermore, introduced is such a method wherein the pattern of the temperature on the surface of the charges is measured from the top of the furnace by the employment of an infrared ray camera, to thus assume the distribution of the flow of gases or the distribution of the charges in the furnace in an indirect manner. However, this category of method of detecting the temperature and the composition of gases is what is serviceable only for grasping the distribution of the flow of gases and the distribution of the charges, specifically the trend thereof, simply qualitatively to some extent. In some case, the method of this category possibly involves a danger of providing even erroneous information. For instance, in the usual practice, when the temperature of the gases at some measuring point is high, or when the CO-to-$CO_2$ ratio in the gases is beyond a reasonable level, the layer of coke is judged to be thick, while the layer of ore is relatively judged to be thin, in the internal region of the filling layer below the said measuring point; therefore, it is duly judged to the effect that the flow velocity of the gases in the said region is high enough, and that permeability is maintained in a favorable state. However, when the temperature in the said region is low, even in case the flow velocity of the gases is high enough, the temperature of the gases present at the top of the furnace is so detected as to be rather lower than the actual level. Furthermore, even in case the thickness of the layer of ore is relatively large, the CO-to-$CO_2$ ratio is prone to be so detected as to be beyond a reasonable level, when the velocity of downward movement of the charges in the said region is slow, or when the temperature is so low that the indirect reducing reaction of ore by the CO gas is checked from taking shape in a proper manner.

SUMMARY OF THE INVENTION

The object of the present invention rests with providing such an operation system for a blast furnace as features that the behavior of the charges in the filling layers in the furnace which exercises a close and inseparable influence on the conditions of permeability, the furnace thermal state, and the like is detected, and control of the blast furnace on the basis of the said behavior is thus enabled in a proper manner.

As a blast furnace is put in operation, such items of raw material as iron ore (including sintered ore) and coke moves in the downward direction, as the matter is well known; however, the velocity of the downward movement thereof and the thickness of the layers thereof are subjected to fluctuations in a ceaseless manner, and the fluctuations in the radial direction in the furnace, in the vertical direction, and/or in the circumferential direction are not uniform, which causes the reaction in the furnace to be likewise subjected to fluctuations. For the purpose of maintaining the reaction in the furnace in a favorable state, it is desirable that the behavior of the said raw material, including movement of the position thereof, the velocity of the movement, fluctuations in the level, changes in density, and/or whether or not iron ore is present, whether or not coke is present, at such a position as is corresponding to a specified measuring position, and how the raw material changes the position thereof, should be well learned, then the quantities of the ore and the coke, the position of the charging thereof, the timing of the charging thereof, and the like, should be selected in a proper manner. Now, a metallurgical furnace, such as a blast furnace or the like, is generally constructed of thick refractory walls, and quite high in terms of the temperature thereof; therefore, it is nothing easy to learn the behavior of the said raw material given above. Such being the situation, in the case of the system introduced in the present invention, one or more hollow tubes is/are so arranged in the body of the furnace in a manner of running through the space in the furnace, one or more magnetic sensor(s) is/are arranged in the said hollow tube(s), and, thereby, the behavior of the raw material in the furnace, especially the behavior of the raw material in the horizontal and/or the vertical direction(s) is caused to be grasped in an infallible manner.

DETAILED DESCRIPTION OF THE EMBODIMENTS

Figure 1A:
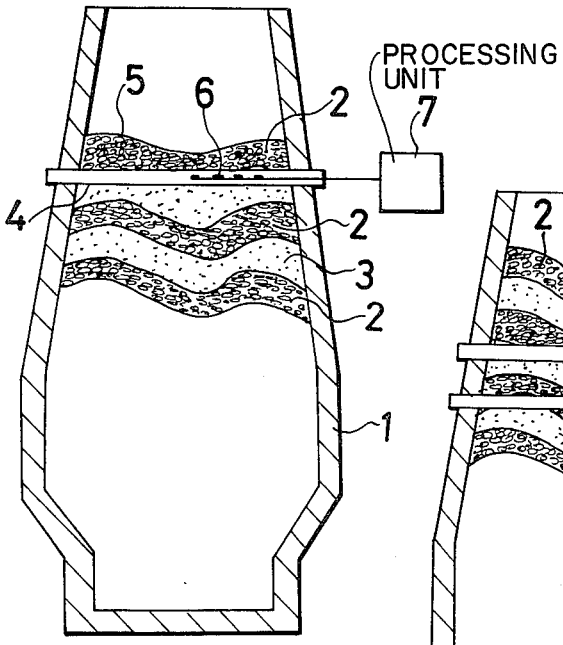
FIG. 1*a* and FIG. 1*b* are longitudinal sections showing respectively separate illustrations of the blast furnace operating system introduced in the present invention.

By making reference to FIG. 1*a*, it is learned that the body 1 of the blast furnace has iron ore 2 and coke 3 charged therein into the shape of laminated layers. The said iron ore 2 (including sintered ore) and the said coke 3 move downward in a manner of attending on the operation of the blast furnace, as the matter is well known. A hollow tube 4 is arranged in place at an optional position below the charging level 5 of the raw material in such a manner as to run through the space in the body 1 of the furnace. The said hollow tube 4 has the magnetic sensor 6 fitted in place in the interior thereof. The constituents of the vector of the magnetic force of the iron ore 2 or the exciting magnetic field are subjected to fluctuations in a manner of attending on the transfer or the downward movement of the said raw material. The magnetic sensor 6 detects the said fluctuations, and feeds the processing unit 7 with the said results of the detection as an input in the form of an output signal. In the said processing unit 7, conducted is well-known signal processing. For instance, such sorts of signal processing as amplification, matching of waveform, and the like, are conducted. Furthermore, the velocity of the downward movement of the charges, the distribution of the thickness of each layer and the shapes of the ore and the coke, are subjected to arithmetic operation. One example of the processing unit 7 is, for instance, disclosed in copending U.S. application Ser. No. 714,788, filed on 16 Aug. 1976, now U.S. Pat. No. 4,122,392 whereof the disclosure is herewith incorporated for reference.

Figure 1B:
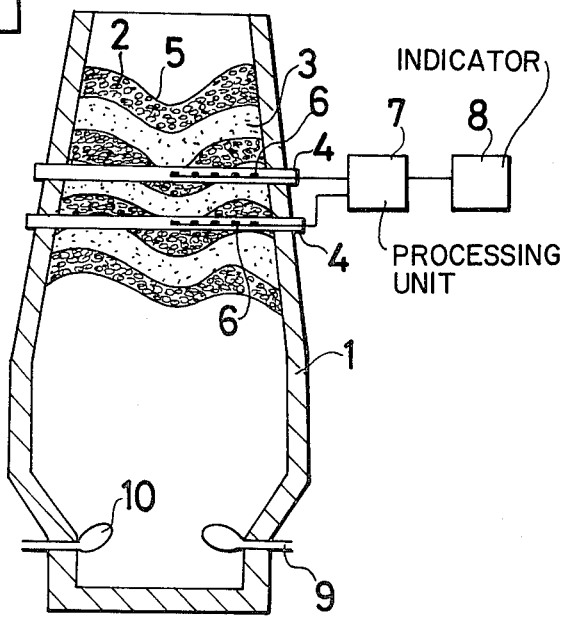

Shown in FIG. 1*b* is another illustration of the present invention. The body of the blast furnace 1 has ore 2 and coke 3 filled therein into the shape of laminated layers in the same manner as in the usual case. In the case of the conventional operation of the blast furnace, coke is subjected to combustion and extinction by virtue of the air blown through a tuyere 9, in the combustion zone 10 arranged in front of the tuyere 9. For this reason, the charges in the furnace move downward. On this occasion, when the surface 5 of the charges reaches the preset level of depth, the subsequent charging is to be effectuated through the top of the furnace. The surface 5 of the charges is thus maintained on virtually the same level. In FIG. 1*b*, a plurality of hollow tubes 4 are arranged in place in a manner of running through the space in the body of the furnace 1 and being parallel to one another, at such an optional position in the charge filling layers as is below the said surface 5 of the charges in the body of the blast furnace 1. The said hollow tube 4 has an optional number of magnetic sensors 6 properly fitted in place in the interior thereof. The said magnetic sensors 6 are arranged in place at each one of such measuring points as are selected in a manner of corresponding to the vertical direction thereof. It is desirable that the position for inserting the hollow tube 4 be selected at such a portion whereat the temperature of the charge filling layers of the blast furnace is below the level of the Curie point of the ore. The distance between a pair of hollow tubes 4 to each other is desirable to be of such a dimension as is less than the thickness of the layer of the coke or the layer of the ore, for instance, the one within the range of 150–300 mm. The said hollow tubes 4 is preferable to be arranged in such a manner as to run through the space in the body of the furnace by way of the center of the furnace. The magnetic sensor 6 detects the fluctuations in such magnetic flux density of the exciting magnetic field as is given birth in a manner of attending on the downward movement of the said charges. The results of the detection are fed into the signal processing unit 7 as an input, in the form of an output signal. In the case of the indicator 8, the result of the arithmetic operation subjected to processing by the signal processing unit 7 and/or the signal output are/is either recorded or indicated.

Now, given below will be the basic principle for detecting the fluctuations in the components of the vector of the said exciting magnetic field.

Figure 2A:
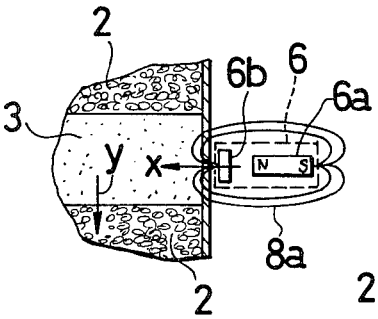
FIG. 2*a*, FIG. 2*b*, and FIG. 2*c* are diagrammatic drawings showing the relation between the magnetic sensor and the raw material, respectively.
Figure 2B:
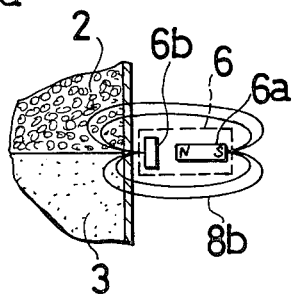
Figure 2C:
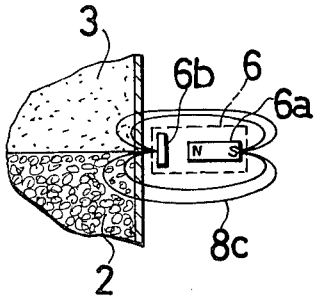

In FIG. 2*a* through FIG. 2*c*, the magnetic sensor 6 is provided with such an exciting section 6*a* as magnetizes the raw material and such a magnetism detecting section 6*b* as detects the fluctuations in the components of the vector of the exciting magnetic field that is subjected to fluctuations by virtue of the downward movement of the raw material. The magnetism detecting section 6*b* is caused to be intersected crosswise at right angles with the direction of the longitudinal axis X of the exciting section 6*a*, to put it otherwise, is properly arranged in such a manner as to be in parallel with the direction of the downward movement of the charges. Now that such a magnetic field 8*a* as is given birth in case the center of the magnetism detecting section 6*b* is positioned at the center of the coke layer 3, for one thing, in such a manner as is shown in FIG. 2*a*, becomes axial symmetry of the longitudinal axis X, to put it otherwise, the components of the vector of the magnetic field in the upper half and those in the lower half become the same in the relation thereof with the longitudinal axis, in the magnetism detecting section 6*b*, the both of the said vectors are caused to offset each other by the directivity of the magnetism detecting section 6*b*, and the output from the magnetic sensor 6 is rendered to zero in terms of the value thereof. In the wake thereof, the downward movement of the raw material makes its advance, and, now that the permeability of the ore 2 is large enough, in case the magnetism detecting section 6*b* is so positioned as to cause the upper half of the magnetism detecting section 6*b* to be confronted with the ore 2, and as to cause the lower half of the magnetism detecting section 6*b* to be confronted with the coke, respectively, in such a manner as is shown in FIG. 2*b*, the line of magnetic force 8*b* is subjected to considerable deflection in the direction of the iron ore 2, and a considerable difference takes shape between the components of the vector in the upper half of the magnetism detecting section 6*b* and those in the lower half of the magnetism detecting section 6*b*. As a result thereof, a deflecting magnetic field is given birth at the magnetism detecting section 6*b*, and the output from the magnetic sensor 6 makes its appearance in the form of a positive value signal. Furthermore, in case the downward movement of the raw material makes its further advance, and the center of the iron ore 2 passes through the longitudinal axis X of the magnetism detecting section 6*b*, the state becomes similar as that shown in FIG. 2*a*. To put it otherwise, the output from the magnetic sensor 6 is rendered to be zero in terms of the value thereof. In case the downward movement of the raw material is caused to make its advance all the more, and the upper half of the magnetism detecting section 6*b* is confronted with the coke 3, then the lower half of the magnetism detection section 6*b* is confronted with the iron ore 2, in such a manner as is shown in FIG. 2*c*, the magnetic field 8*c* is rendered to be in an exactly reverse state to that shown in FIG. 2*b*. To put it otherwise, the magnetic sensor 6 causes a negative value signal to be generated therefrom as an output. In such a state as this, the above-mentioned output signal from the said magnetic sensor 6 is fed to the signal processing unit 7 as an input, and the said signal processing unit 7 is caused to conduct the well-known signal processing therein.

Now, the magnetic sensor 6 shown in FIG. 2*a* through FIG. 2*c* is provided with an exciting section 6*a*, and causes an exciting magnetic field to be formed out of the said exciting section 6*a* in an active manner, to thus detect the fluctuations in the said exciting magnetic field. However, some iron ore 2 has in itself a fairly high level of magnetizing force, as the matter is well known. Therefore, in such a case, the behavior of the raw material can be detected by the application of the same principle as that set forth above, likewise through proper detection of such magnetizing force, in its unmodified state, as is borne in the said iron ore 2 itself.

The magnetic sensor 6 is specifically designed for the purpose of detecting the fluctuations in the components of the vector of the magnetizing force or the exciting magnetic field borne by the said iron ore 2. Recommendable for use as the magnetic sensor is either one of the following items including a manifest magnetism-to-electricity conversion element, a gaussmeter, and any manifest magnetism detector. An especially effective and typical magnetic sensor is the one of the SMD (Sony Magneto Diode) type, the Hall element type making use of the Hall effect, the search coil type, the dc-ac flux-gate type, the electric resistance effect type, or the like; however, for the purpose of obtaining an output featuring stability and high sensitivity, a magnetic sensor of the magnetic multivibrator type disclosed in the Application, U.S. Ser. No. 714,788, cited in the foregoing paragraph.

The magnetism detecting section 6*b* is generally termed a magnetometer as well; however, the one introduced herein is such a magnetic sensor as is provided with a magnetic sensitive section (a magnetometer in a narrow sense) and such a driving circuit section as feeds electric power for signal oscillation. And, the said magnetic sensitive section selects such a characteristic as is free from being saturated by the exciting magnetic field. Next, the exciting section 6*a* usually comprises a permanent magnet; besides, the exciting section 6*a* may be such wherein a coil is wound up around a magnetic core which is caused to excite by either an AC power source or a DC power source, or such that is caused to excite by a coil alone, hence including no magnetic core, though none of such are shown in the drawing; and proper selection of either one may be made pursuant to the criteria including the intensity of the exciting magnetic field, the dimensions of a magnet, and whether or not the one to be thus selected is easy to handle.

Figure 12:
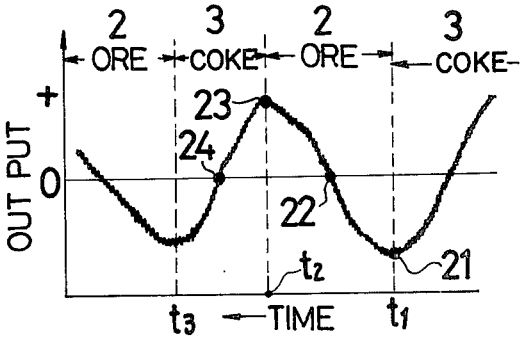
FIG. 12 is a waveform diagram of the output from the magnetic sensor.

Now, how the state of a signal to be oscillated as an output in a manner of corresponding to the position of the magnetic detecting section 6*b* in the layer of ore or the layer of coke is subjected to fluctuations will be described below by making reference to FIG. 12. In case the upper half of the magnetism detecting section 6*b* is confronted with the coke 3, and the lower half of the magnetism detecting section 6*b* is confronted with the ore 2 (time $t_1$), the ore 2 is large enough in terms of the permeability thereof; therefore, the line of magnetic force is deflected a great deal in the direction of the ore, that is to say, in the downward direction, and a difference takes shape between the components of the vector in the upper half of the magnetism detecting section 6*b* and those in the lower half of the magnetism detecting section 6*b*. As a result, a deflected magnetic field takes shape. Thereby, the output from the magnetic sensor assumes the shape of a negative value signal 21. When the center of the coke 3 passes through the central axis X of the magnetism detecting section 6*b* in a manner of attending on the further downward movement of the charges, the line of the magnetic force becomes axially symmetrical in its relation to the longitudinal axis X; therefore, a zero signal 22 is oscillated as an output from the magnetic sensor. When the downward movement further makes its advance, and the center of the magnetism detecting section 6*b* reaches the boundary between the coke 3 and the ore 2, to put it otherwise, when the upper half of the magnetism detecting section 6*b* is confronted with the ore 2, and the lower half of the magnetism detecting section 6*b* is confronted with the coke 3 (time $t_2$), the state becomes exactly reverse to that at the time of $t_1$. In this case, now that the line of the magnetic force is deflected a great deal to the side of the upper ore 2, a positive value signal 23 is oscillated as an output from the magnetic sensor 6. Thereafter, likewise, when the downward movement further makes its advance, and the center of the ore 2 passes through the center of the magnetism detecting section 6*b*, a zero signal 24 is oscillated as an output from the magnetic sensor 6. To sum up, the signal output of the magnetic sensor 6 becomes maximum or minimum in value at the boundary between the layers of the ore 2 and the coke 3, to thus find such a series of time of $t_1$, $t_2$, $t_3$, . . . as are corresponding to the respective extreme points. However, instead of following the above-mentioned method, such a method that the axis of the magnetism detecting section 6*b* is so caused as to be parallel with the axis X, for one thing, may be modified in such a manner that the magnetism detecting section 6*b* is so arranged in place as to render the signal output to be reduced to the level of zero at the boundary between the layers of the ore 2 and the coke 3.

In the case of arranging a plurality of magnetic sensors 6 in the upper and lower hollow tubes 5, it is preferable that the magnetic sensors in the relation of vertical arrangment be arranged in such a manner as to be corresponding to each other in the vertical direction.

Now, with regard to the magnetic sensor 6, one or a plurality thereof is/are either fixed in place with every optional spacing or fitted in place in a manner of enabling the position(s) thereof to be modified. The systems for varying the positon(s) of the magnetic sensor(s) in the hollow tube 4 are as shown in FIG. 3 and FIG. 4.

Figure 3:
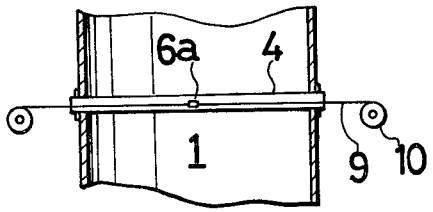
FIG. 3 and FIG. 4 are partial sections showing an apparatus for transferring the magnetic sensor.

In the case of the system shown in FIG. 3, a wire 9 or a chain is fitted in place at the both ends of the magnetic sensor 6*a*, and the modification of the position(s) is effected, while winding the said wire 9 or the chain on a drum 10 arranged in the direction of the travel of the magnetic sensor 6*a*, either by means of a driving gear or by virtue of manpower.

Figure 4:
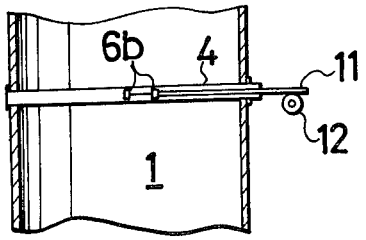

In the case of the system shown in FIG. 4, the magnetic sensor 6*b* is fixed in place at the top of a rod 11, and the rod 11 is caused to travel in the forward and rearward directions by means of such a pinion gear 12 as is put to rotation through a driving gear.

Other system available is such, not shown in the drawing as it is, that the rod 11 is caused to travel by the application of either the well-known cylinder drive system or the screw drive system, whereby the magnetic sensor 6*b* is caused to travel to an optionally selected position.

In the case of the present invention, the term of a transfer apparatus has such a connotation as includes the said wire 9, chain, and the rod 11, to be employed for modifying the position of the magnetic sensor 6 in an optional amnner, also the above-mentioned driving gears.

Figure 5:
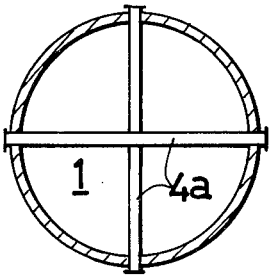
FIG. 5 and FIG. 6 are outlined plans showing the state of the arrangement of the hollow tubes.
Figure 6:
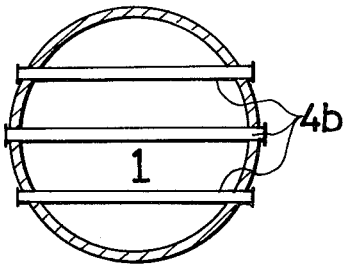

Now, the hollow tube 4 is arranged at an optional position below the raw material charging level 5 of the body of the furnace 1 in a manner of running through the space in the body of the furnace 1, as set forth in the foregoing paragraph. The arrangement of the said hollow tube 4 in the body of the furnace is not necessarily required to be definitively effected in such a single direction as is shown in FIG. 1. The said arrangement may be effected in a manner of causing a couple of hollow tubes 4 to intersect each other at right angles, for one thing, as shown in FIG. 5. And, it is allowed likewise that a plurality of hollow tubes 4*b* are arranged in parallel with one another in such a manner as is shown in FIG. 6. Furthermore, it goes without saying that can be effected into a plurality of vertical stages in view of the direction of the height of the furnace. Which one of them to select is simply a matter to be optionally decided in a manner of corresponding to the size of the body of the furnace 1 and the shape thereof as well. The number of the magnetic sensor(s) to be fitted in place and the means of fitting the same may be decided in an appropriate manner in a manner of corresponding and best suiting the conditions of arrangement of the said hollow tubes 4.

Figure 7:
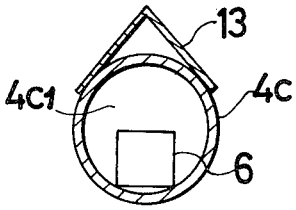

Shown in FIG. 7 is such a sectional view as exemplifies one illustration of the hollow tube 4. The cylindrical hollow tube 4*c* has the magnetic sensor 6 fitted in place in the interior thereof. The said hollow tube 4*c* has such a protective cover 13 as is designed to achieve the purpose of preventing the wear of the hollow tube 4*c*, and to ensure the smooth downward movement of the raw material, specifically arranged on the top surface of the said hollow tube 4*c*. It proves effective enough that the hollow tube 4*c* is made of such material as stainless steel, copper, or other non-magnetic substance. In the case of this illustration, a stainless steel pipe is selected for employment. However, the shape of the section of the hollow tube 4 is not definitively limited to the effect of having a cylindrical shape. Such other shape as, for instance, a triangular cylinder or a quadrangular cylinder is well acceptable. It goes without specifying that the protective cover is not always indispensable an item; however, it is still recommendable that the hollow tube 4 be what is made of such a category of material as is well durable against the resistance to the downward movement and the load of the laminated raw materials.

Now, it may be pointed out that there is a possibility that the lower part of the body of the furnace 1 becomes higher in terms of the temperature than the higher part thereof, some position for the arrangement of the hollow tube 4 is prone to adversely affect the magnetic characteristics due to the said temperature, and the conditions and the state of working of the present invention are thereby to be impeded. In case the hollow tube 4 is arranged at a comparatively upper position of the body of the furnace 1, and virtually no problems are involved in terms of the said temperature, such a construction as simply has the magnetic sensor 6 alone fixed in place in the interior of the hollow tube 4*c* in a manner shown in FIG. 7 may be acceptable. However, as the position for the arrangment of the hollow tube 4 is to be selected at a lower portion, consideration with regard to the said temperature is required to be given.

Figure 8A:
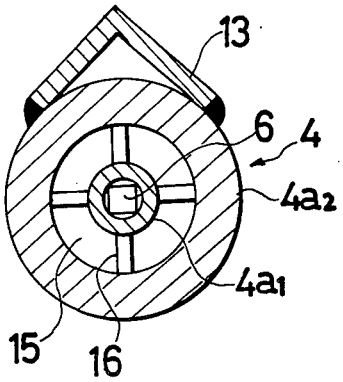
FIG. 7, FIG. 8*a*, and FIG. 8*b* are longitudinal sections respectively showing the internal construction of the hollow tubes.
Figure 8B:
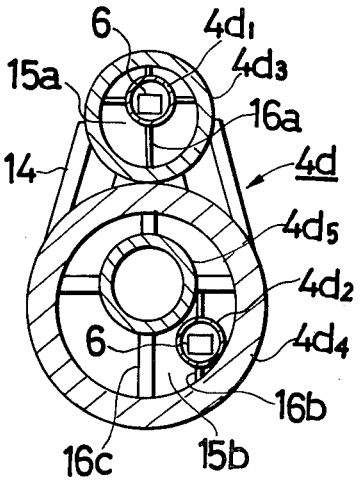
Figure 9:
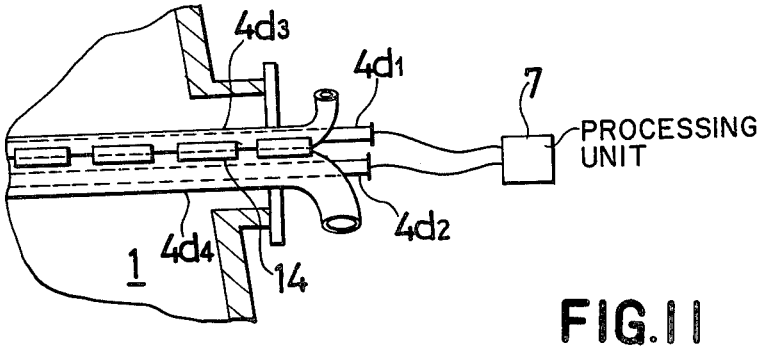
FIG. 9 is such a side view, including a sectional view showing a part, as displays the state of fitting of the hollow tube shown in FIG. 8*b* on the body of the furnace.

Shown in FIG. 8*a* and FIG. 8*b* is one illustration of such a hollow tube 4*d* wherein a measure is taken to cope with the said temperature. FIG. 9 shows the state of fitting the said hollow tube 4*d* on the body of the furnace 1.

In the case of the illustration shown in FIG. 8*a*, a cylindrical inner hollow tube $4a_1$ has the magnetic sensor 6 fitted in place therein. The said cylindrical inner hollow tube $4a_1$ has an outer hollow tube $4a_2$ arranged in place at the outside thereof in a manner of encircling the said inner hollow tube $4a_1$. The both of the said hollow tubes are properly retained by a supporting plate 16*a*. And, the hollow tube $4a_2$ has such a protective cover 13 as is designed for preventing the wear of the said hollow tube $4a_2$ and ensuring the smooth downward movement of the charges specifically arranged on the top surface thereof. It proves effective enough that the said hollow tube 4*a* and the said protective cover 13 are made of a non-magnetic substance featuring a high level of strength. In the case of this illustration, a stainless steel pipe is selected for use. By the bye, the shape of the section of the hollow tube 4 is not definitively limited to be that of a circular pipe, nor is it such that requires, needless to say, the protective cover 13, either; however, the hollow tube 4 still have to be the one that has the sufficient strength to withstand the load of the charges and the wear. Now, the temperature in the furnace becomes higher in the lower portion than that in the higher portion, and, at some position for arranging the hollow tube 4, there is a possibility that the state of working of the magnetic sensor 6 is impeded by the high temperature. Therefore, in order to maintain the magnetic sensor 6 in a favorable working state within such a temperature range wherein the magnetic characteristics are detected, even under the condition of such high temperature, such a cooling agent passage 15 as is formed between the outer hollow tube $4a_2$ and the inner hollow tube $4a_1$ was arranged, a cooling agent was caused to run in the said passage 15, and not only the magnetic sensor 6 but also the hollow tube 4 were subjected to cooling. It goes without saying that, in case the position for arranging the hollow tube 4 is in a comparatively high portion of the body of the furnace 1, and virtually no problem is involved in terms of the said temperature, it is needless to cause a coolant to run in the said cooling agent passage 15, and, such a simplified construction wherein neither the inner hollow tube $4a_1$ nor the supporting plate 16*a* is arranged, and the magnetic sensor 6 alone is fitted in place in the outer hollow tube $4a_2$, may be acceptable, whenever so allowed by the case. Besides, with regard to the cooling agent, such a well-known gas refrigerant as air, nitrogen, or the like, or such a liquid refrigerant as water, oil, or the like, may be properly selected for use in a manner of best suiting the ambient temperature and the shape of the hollow tube 4.

In the case of the illustration shown in FIG. 8*b*, such a hollow tube 4*d* wherein a plurality of magnetic sensors can be fitted into two stages is arranged in place. The magnetic sensors 6 are respectively fitted in place on the inner hollow tubes $4d_1$, $4d_2$. The inner hollow tubes $4d_1$, $4d_2$ have the outer hollow tubes $4d_3$, $4d_4$ arranged vertically outside thereof in a manner of encircling the said inner hollow tubes $4d_1$, $4d_2$, respectively, and the said outer hollow tubes $4d_3$, $4d_4$ are respectively fixed in place by way of a fixing rib 14. In the case of this illustration, the outer hollow tube $4d_4$ positioned in the lower portion is so designed as to be comparatively large a one, in view of the strength of the hollow tube 4*d*. For this reason, the outer hollow tube $4d_4$ has an inner tube $4d_5$ arranged in place in the interior thereof, for the purpose of using the undermentioned cooling agent in an effective manner. The inner hollow tube $4d_2$ is arranged in place between an intertubular tube $4d_5$ and the outer hollow tube $4d_4$.

A cooling agent circulation 15*a* is formed between the outer hollow tube $4d_3$ and the inner hollow tube $4d_1$, and a cooling agent circulation 15*b* is formed between the outer hollow tube $4d_4$ and the inner tube $4d_5$, and between the outer hollow tube $4d_4$ and the inner hollow tube $4d_2$, respectively. A cooling agent is caused to run in the said circulations 15*a*, 15*b*, respectively, to thus conduct cooling of the hollow tube 4*d* and the magnetic sensor 6. Now, in FIG. 8*b*, the items 16, 16*a*, 16*b*, and 16*c* are such supporting plates as retain the inner hollow tubes $4d_1$, $4d_2$, and the inner tube $4d_5$, respectively. The said illustration is such wherein the magnetic sensor 6 is caused to be cooled indirectly through the inner hollow tubes $4d_1$, $4d_2$. Now that the sectional area for a cooling agent to pass can be reduced, only a small quantity of a cooling agent proves to be enough for conducting effective cooling. Furthermore, measurement of the temperature in the furnace and sampling of gases can be conducted by making use of the interior of the inner tube $4d_5$. However, in case the magnetic sensor 6 and the cooling agent can be caused to come in contact with each other, and the quantity of the cooling agent available is large enough, such a method wherein, for instance, the cooling agent is caused to directly pass through such an inner space $4c_1$ of the hollow tube 4*c* as is shown in FIG. 7 may be applied as a substitutive one therefor.

In the case of the present invention, the cooling agent circulation system represents a general term for such a series of circulations through which a cooling agent for cooling the hollow tube 4 and the magnetic sensor 6 is caused to run (to put it in concrete terms, the said cooling agent circulations 15, 15*a*, 15*b*, and the inner space $4c_1$ of the hollow tube 4*c*.) with regard to the cooling agent, such a well-known gas refrigerant as air, nitrogen, or the like, or such a liquid refrigerant as water, oil, or the like, may be properly selected for use in a manner of best suiting the ambient temperature, the shape of the hollow tube, and so forth.

Figure 11:
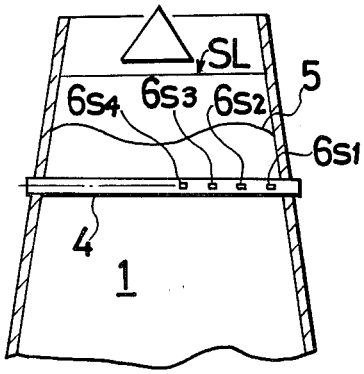
FIG. 11 is a partial sectional view showing the conditions of the arrangement of the hollow tube and the magnetic sensors.
Figure 10:
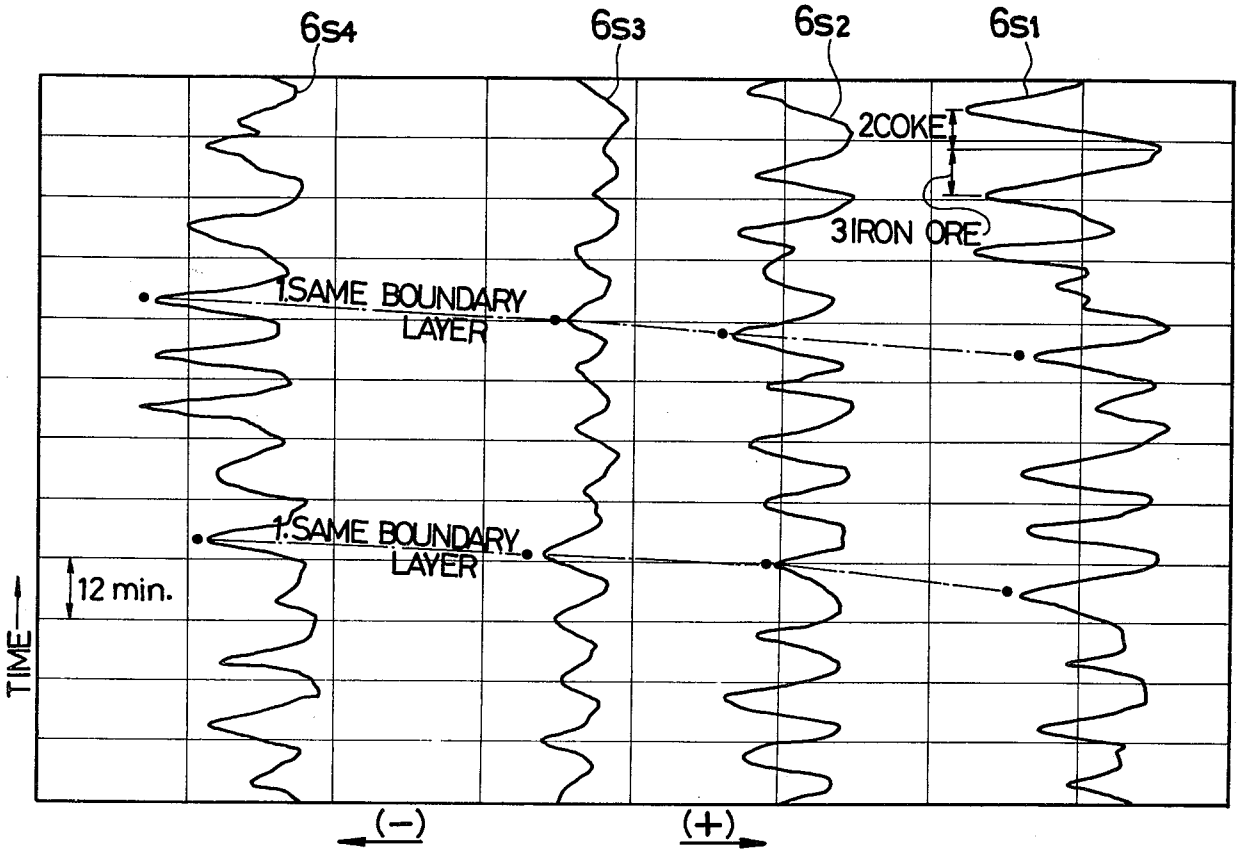
FIG. 10 is a line drawing showing an example of the results of detection by the magnetic sensor of the conditions of the operation of the furnace.

FIG. 10 is a diagram wherein the output signals from four magnetic sensors $6s_1$–$6s_4$ fixed in place with spacings of 890 mm on the hollow tube 4 arranged 4,100 mm below the stock line S.L. (this stock line S.L. represents the horizontal surface selected at the level of 1 m below the lower end of the lower bell measured at the time of the downward movement of the charges) of a blast furnace of 2,800 $m^3$ in internal volume are indicated in parallel as shown in FIG. 11. In the diagram, the ordinate axis indicates the lapse of time, and each scale interval represents the span of 12 minutes. And the transverse axes are what indicate the direction and the level of the output signals. What is indicated in the rightward direction represents a positive value (+), and what is indicated in the leftward direction represents a negative value (−), respectively. The point of the peak value is the boundary layer between the iron ore 2 and the coke 3, as readily learned through the description of the basic principle given in the foregoing paragraph.

Next, given below will be a description as to the methods of detection of the distribution of the velocity of the downward movement, the distribution of the thickness of the layer, and the distribution of the shape, respectively, of the charges fed into the furnace, by the application of a treatment process of arithmetic operation.

Figure 13:
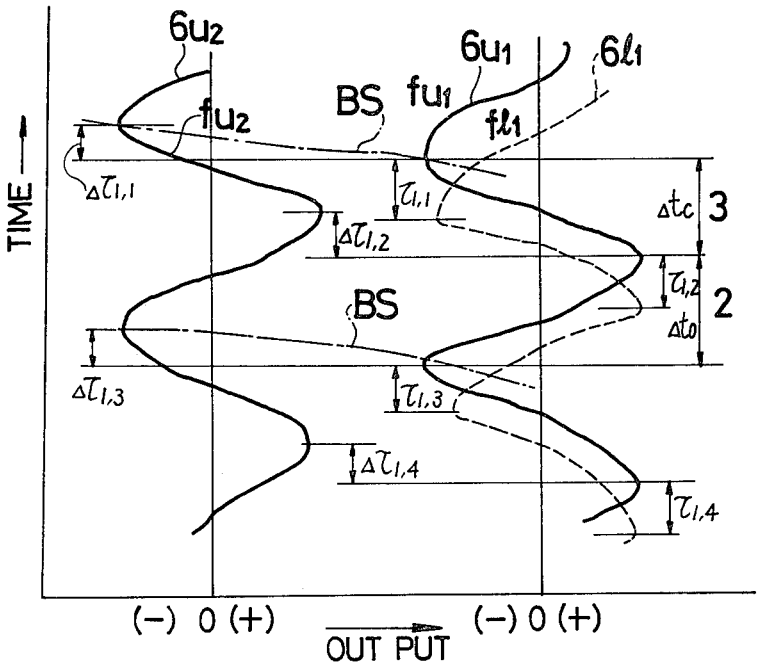
FIG. 13 is a definitive drawing of the calculation of the velocity of downward movement, the thickness of the layers, and the angle of inclination of the charges in the magnetic sensor's signal processing unit.
Figure 14:
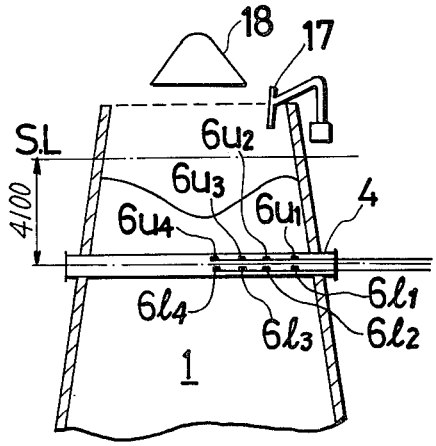
FIG. 14 is a partial sectional view showing the conditions of the arrangement of the hollow tubes and the magnetic sensors.

Shown in FIG. 13 is a typical representation of the signal output $fl_1$ from such a magnetic sensor $6l_1$ as is arranged in place in such a manner as to be corresponding to the vertical direction on the lower stage of the magnetic sensor $6u_1$, (the signal output shown by a dotted line), as well as the signal outputs $fu_1$, $fu_2$ from such magnetic sensors $6u_1$, $6u_2$ as are arranged in place at a couple of adjoining points on the upper stage thereof in the direction of the diameter of the furnace in the case of arranging the magnetic sensor 6 on a couple of vertically sectioned stages at a plurality of measuring points in the direction of the diameter of the furnace in the interior of the hollow tube 4, in such a manner as is shown in FIG. 14. Here, the affixed digits of $_1$ and $_2$ represent the measuring points, respectively. In FIG. 13, the ordinate axis represents the lapse of time, the transverse axes represent the direction and the level, respectively, of the output signal, what is indicated in the rightward direction represents a positive value (+), and what is indicated in the leftward direction represents a negative value (−). As described above with regard to the basic principle. the point of the peak value is the boundary layer between the iron ore 2 and the coke 3, and, the interrelation between the behavior of the charges at respective measuring points and the behavior of the charges in the direction of the diameter of the furnace, also the common boundary surface thereof, can be confirmed in a clear and distinct manner. Now, a method of calculating the velocity of the downward movement of the charges at the measuring point 1, by taking the output signals $fu_1$, $fl_1$ from such magnetic sensors $6u_1$ and $6l_1$ as are corresponding to each other in terms of the vertical relation thereof, as shown in FIG. 13, as the criteria thereof, can be given in the form of the formula given below, through the calculation of the mean value $\tau_1$ of the time differences $\tau_1$, i (i=1, 2, 3, . . . ) between the peaks of the curves of $fu_1$ and $fl_1$ for the immediately preceding and optionally set period of time, for instance, 30 minutes or 1 hour in the past.

$$V_1 = H/\tau_1$$

Here, $V_1$: Velocity of the downward movement of the charge at the measuring point 1 in the direction of the diameter of the furnace H: Distance between the magnetic sensor on the upper stage and the magnetic sensor on the lower stage The above-mentioned method is such a category of method wherein the said time differences $\tau_1$, i between the peaks of the curves are integrated in a sequential manner in the signal processing unit, to thus conduct proper calculation of the mean value in a certain preset period of time; however, such a substitutive method wherein the velocity $V_1$ of the downward movement of the charge is found by the employment of such a correlation analysis meter as is set forth below may be followed, wherever practicable. To put it in concrete terms, now that the signal outputs, $fu_1$ and $fl_1$, are not always formed into a similar figure for such reasons as either a local or temporary difference in the velocity of the downward movement of the charges and a fluctuation in the state of mixing of the charges with each other, the cross correlation coefficient between $fu_1$ and $fl_1$ is to be calculated by the application of the formula (2) given below.

$$g(\tau) = \int_0^T fu_1(t) \cdot fl_1(t-\tau)dt \quad (2)$$

Here, $g(\tau)$: Cross correlation coefficient $fu_1$, $fl_1$: Signal outputs from the magnetic multisensors 6 on the upper stage and the lower stage, respectively t: Time T: Correlation operation time span (preset time)

$\tau$: Deflection of time (difference in time between the peaks)

When the deflection of time $\tau$ whereat the value of $g(\tau)$ calculated by the application of the formula (b 2) given above reaches the maximum level thereof is substituted by $\tau_1$, $\tau_1$ can be found in the form of the time difference between the said peaks, and then the velocity $v_1$ of the downward movement of the charges can be calculated by the application of the formula (1) given above. Thus, the velocities $v_1$, $v_2$, $v_3$, . . . of the downward movement of the charges at the measuring points 1, 2, 3, . . . in the direction of the diameter of the furnace can be found by the application of either one of the abovementioned methods.

Aside from the description given above, one or more of such level meters as a sounding level meter, a microwave level meter, and an ultrasonic wave level meter, can be fitted in place, to thus add such a process as finds the velocity of the downward movement of the charges in the furnace, by taking the distance of the downward movement of the surface of the filling layer of the charges in the set period.

Now, the distribution of the thickness of the respective layers of the iron ore 2 and the coke 3 at the respective measuring points can be found by the application of such a method as is introduced below. To put it in concrete terms, the time $\Delta to$ for the layer of the iron ore to pass the measuring point 1, and the time $\Delta tc$ for the layer of the coke to pass the measuring point 1, respectively shown in FIG. 13, are subjected to arithmetrical operation in the course of the above-mentioned signal processing, and, the thickness ho of the layer of the iron ore and the thickness hc of the layer of the coke, at the measuring point 1, respectively, are to be found by the application of the respective formulas (3), (4) given below.

$$ho = v_1 \cdot \Delta to \quad (3)$$

$$hc = v_1 \cdot \Delta tc \quad (4)$$

In the case of subjecting $\Delta to$ and $\Delta tc$ to arithmetical operation, either the time for only a single layer of the iron ore 2 or the coke 3 to pass the measuring point 1, or the mean time for a plurality of layers of the iron ore 2 or the coke to pass the measuring point in an immediately preceding and optional preset period of time, may be selected as a criterion thereof, and the selection of either one may be effected at liberty in such a manner as to best suit the practical purpose. The same method as that set forth above can be applied for detecting the thickness of the layer ho, i (i=1, 2, 3, . . . ) of the iron ore 2, and the thickness of the layer hc, i (i=1, 2, 3, . . . ) of the coke 3, as well as the velocity vi (i=1, 2, 3, . . . ) of the downward movement of the charges, at a plurality of measuring points in the direction of the diameter of the furnace, respectively.

Next, given below will be a description as to one illustration of the method of detecting the shape and the distribution of the charges, to put it otherwise, the angle of inclination of the charges, at a plurality of measuring points 1, 2, on the basis of the signal outputs $fu_1$, $fu_2$ of a couple of magnetic sensors $6u_1$, $6u_2$ adjoining to each other in the direction of the diameter of the furnace. In FIG. 13 when the iron ore 2 and/or the coke 3 of such thickness of the layer(s) thereof of twice as much that/-those to be charged in a usual case is/are fed as the charge(s) from the top of the furnace in a temporary manner, either (i) by the application of the method of calculating the difference in mean time $\Delta\tau_1$ between the peaks of the curves $fu_1$, $fu_2$ by the use of the method of the cross correlation analysis set forth in the foregoing paragraph in connection with the method of calculation of the velocity of the downward movement of the charges, or (ii) by the application of the method of double charging (such a method in which the weight of the charges to be charged each time from the top of the furnace is increased by twice as much temporarily), wherein the same boundary surface BS is detected out of such characteristic patterns taking shape in the output signals $fu_1$, $fu_2$ of the said magnetic sensors, and also the mean value $\Delta\tau_1$ of the time difference $\Delta\tau_1$, i (i=1, 2, 3, . . . ) between the peaks of the curves corresponding to each other at a couple of adjoining measuring points in the immediately preceding and optional preset period of time is calculated. Thus, the angle of inclination $\theta_{1,2}$ between such adjoining two points (1 and 2) as have the same boundary surface BS can be found by the application of the formula given below (in the case of selecting the measuring point 1 as the criterion thereof).

$$\theta_{1,2} = \tan^{-1}(\alpha_{1,2}/L_{1,2}) \quad (5)$$

Here, $L_{1,2}$: Distance between the magnetic sensors at the adjoining measuring points in the direction of the diameter of the furnace $\alpha_{1,2}$: Distance of deflection of the measuring points 1 and 2 on the same boundary surface BS in the direction of the height of the furnace, and the value of the said distance can be found by the application of the formula (6) given below.

$$\alpha_{1,2} = V_2 \cdot \Delta\tau_1 + \beta_{1,2} \quad (6)$$

Here, $V_2$: Velocity of the downward movement of the charges at the measuring point 2

$\beta_{1,2}$: Distance of deflecton of the measuring point 2 in the downward direction in the case of selecting the measuring point 1 as the criterion thereof, By the application of the same method as that set forth above, the angle of inclination of the charges between a couple of adjoining points in the direction of the diameter of the furnace, to put it otherwise, the distribution of the shape of the charges, can be properly found in a sequential manner.

As set forth in details in the preceding paragraphs, the present invention is what is specifically contrived for the purpose of detecting in a secure and precise manner the behavior of the charges present in the filling layers in the body of the furnace 1, by arranging an optional and plural number of magnetic sensors 6 in the interior of such a hollow tube 4 as is arranged in the filling layers of the charges in the body of the furnace 1, into a vertical and parallel arrangement, and in a manner of corresponding to the vertical direction, and indicating the results of the said detection on an indicator, thereby conducting the control of a blast furnace in the most suitable manner possible. Given below will be a description as to the effects to be achieved by the application of the present invention, by making reference to the results of working of the present invention.

Figure 15:
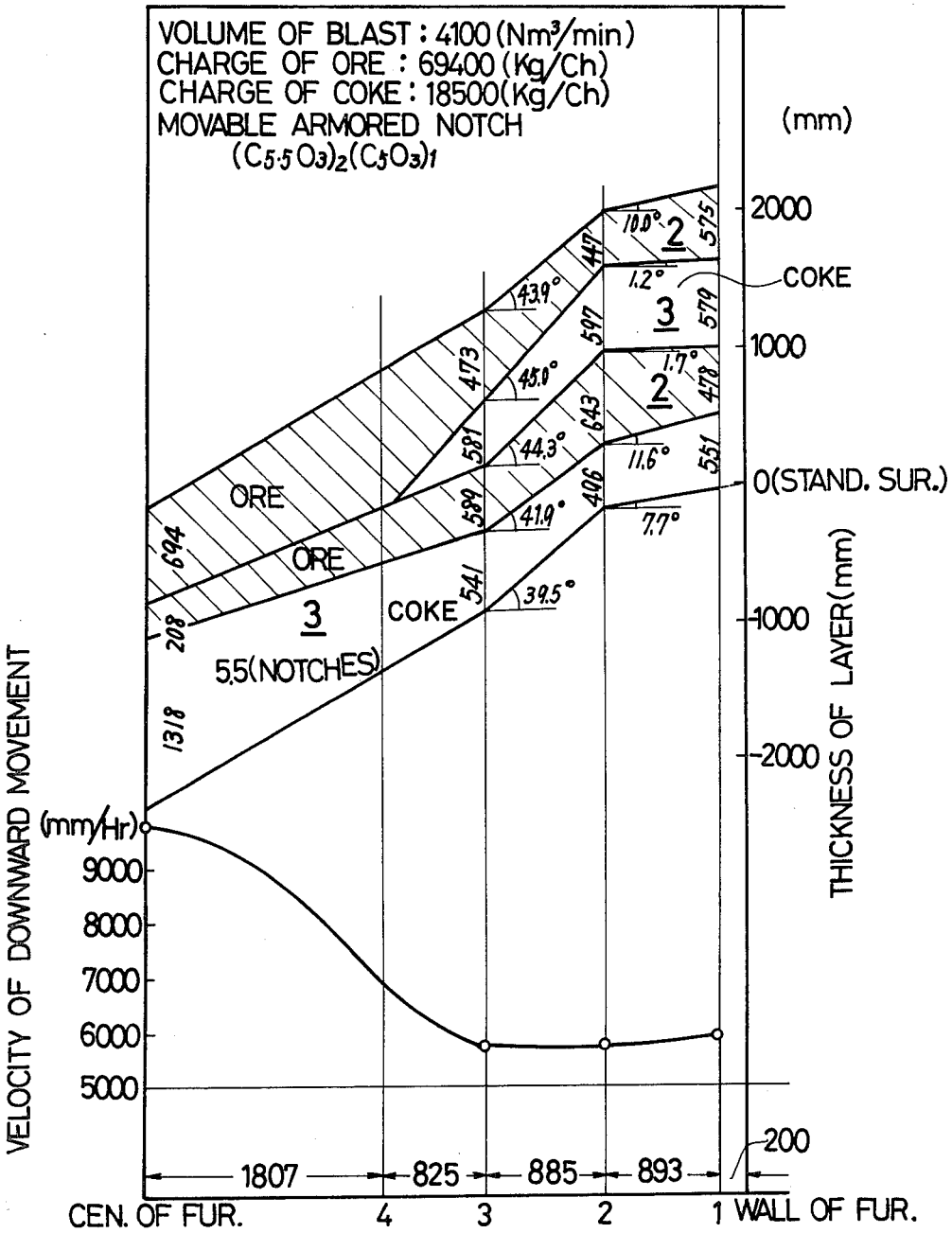
FIG. 15 is a diagrammatic representation of the distribution of the thickness of the layers of the charges and the distribution of the shapes of the charges in the charge filling layers, specifcally showing an example of the results of working by the employment of the system shown in FIG. 14.

Shown in FIG. 14 is one illustration of the present invention, wherein as many as eight magnetic sensors, including $6u_1$–$6u_4$ abd $6l_1$–$6l_4$, are fitted and fixed in place at two stages in the vertical arrangement with spacings of 890 mm in the direction of the diameter of the furnace, in the interior of such a hollow tube 4 as is arranged at a position 4,100 mm below the stock line (usually termed the SL in an abbreviated form, and purporting the horizontal surface at the level of 1 m below the lower end of the lower bell 18 at the time of the downward movement of the charges) in the blast furnace of 2,800 $m^3$ in internal volume, and an example of the results of the detection of the distribution of the velocity of the downward movement of the charges, the distribution of the thickness of the layers of the iron ore 2 and the coke 3, and the distribution of the shape of the charges, in the direction of the diameter of the furnace in the interior of the filling layers of the charges in the furnace, as learned by conducting the said processing of the output signals from the said magnetic sensors $6u_1$–$6u_4$ and $6l_1$–$6l_4$ through the output signal processing unit 7 is as shown in FIG. 15. In the drawing, the ordinate axes represent the layer height distance or the layer thickness and the velocity of the downward movement in the case of selecting the lower end surface of the standard coke layer 3 in the vicinity of the wall of the furnace as the criterion thereof, and the transverse axes represent the positions of the arrangement of the magnetic sensors $6u_1$–$6u_4$ and $6l_1$–$6l_4$ in the direction of the radius of the furnace in a manner of corresponding to the vertical direction.

Introduced in this illustration are the results of the measurements conducted under such conditions that the quantities of the charged fed into the furnace through the top thereof were 69.4 tons of iron ore 2 and 18.5 tons of coke at one time, and the conditions of control of the armored notch by a movable armor (17 in FIG. 14) effected in this case were of such frequencies as once of 5 notches and twice of 5.5 notches at the time of charging of coke, and 3 notches at the time of charging of iron ore. Shown in FIG. 15 is such an example wherein different kinds of coke were selected and used for 5 notches and 5.5 notches. By the way, shown in this drawing is that the charge having a larger number of notches is to be charged nearer to the center of the furnace. Therefore, under the working conditions shown in the drawing, coke is charged nearer to the center of the furnace than iron ore, which reveals that emphasis in this case of working was placed on that the layer of iron ore was made thicker in the vicinity of the wall of the furnace, while the layer of coke was made thicker at the center of the furnace, in a relative manner. Furthermore, in the case of this illustration, fitting of the hollow tube 4 on the body of the furnace 1 was conducted in such a manner as is shown in FIG. 8*b*. And, in FIG. 15, the hatched portion is the layer of iron ore 2, and the blank portion is the layer of coke 3.

Besides, in the drawing, the case wherein the number of the notches formed on the coke is 5 and the case wherein the number of the notches formed on the coke is 5.5 are indicated in a separate manner, which reveals that only such data as were related only to the coke 3 charged with 5 notches formed thereon, for one thing, were subjected to integration or an averaging process, on the basis of the signals from the respective multi-sensors, within the period of approximately 4 hours, to thus find the distribution of the thickness of the layer and the angle of inclination (distribution of the shape) of the 5-notch coke 3; and the same method was applied for finding the distribution of the thickness of the layer and the angle of inclination of such coke 3 as was charged into the furnace with 5.5 notches formed thereon. In the drawing, also made entry are the results of the calculation of the thickness of the layer and the angle of inclination of the iron ore 2 and the coke 3 at the respective measuring points; however, it is confirmed clearly and distinctly that the distribution of the thickness of the layers and the angle of inclination (distribution of the shape) of the charges in the direction of the diameter of the furnace or in the direction of the height of the furnace were subjected to fluctuations a great deal, and the distribution of the shape in the direction of the diameter of the furnace is not linear, but sharp in inclination at an intermediate portion apart slightly from the wall of the furnace, furthermore, gentle in inclination in the portions in the vicinity of the wall of the furnace and at the center of the furnace. To add up thereto, it can be judged that the velocity of the downward movement of the charges at the center of the furnace is in excess of that in the portion in the vicinity of the wall of the furnace.

Now, the behavior of the charges in the direction of the diameter of the furnace or in the direction of the height of the furnace, in the filling layer of the charges in the furnace, including the velocity of the downward movement, the thickness of the iron ore 2 and the coke 3, the state of the distribution of the angle of inclination (the shape), the trend of the fluctuations in the said distribution, and the difference in such proper preset standard values as were found under the previously established favorable working conditions with regard to the said respective kinds of distribution of the charges, and/or the ununiformity, can be grasped correctly and accurately enough in a clear and distinct manner, modification of the charge of the ore 2 or the coke 3 from the top of the furnace, or control of the distribution of the charges by a well-known movable armor or the like, can be effected on the basis of the difference in the said preset standard value, or a fundamental improvement of the condition of the furnace can be materialized by proper control of charging, including modification of the depth of charging, and/or improvement of permeability or control of furnace heating can be achieved by proper control of the blast of air, including increase/decrease in the level of the blast of air, or modification of the flow of heavy oil, the flow of oxygen, the temperature of the blast, or the humidity of the blast, and, rationalization of the velocity of the flow of gases in the furnace, uniforming of the distribution of the flow of gases, and/or improvement of the reducing efficiency by gases, can be achieved.

Now, given, hereunder will be a description of the outline of the theory whereupon to effectuate control of charging, control of the blow, and control of pressure at the furnace top by detecting the distribution of the velocity of the downward movement, the distribution of the thickness of the layers, and the distribution of the shape, of the charges present in the blast furnace, either in the direction of the diameter of the furnace or in the direction of the height of the furnace. To start with, control of charging is roughly classified into two categories, including control of charge volume and control of distribution of charge, whereof the former, or control of charge volume, is control of charge of iron ore 2 or coke 3, and is applied for attaining the following two objectives. One of the two objectives of the use thereof is either reducing the charge of the iron ore or increasing the charge of the coke in such a case wherein either the mean velocity of the downward movement of the charges to be found from the distribution of the velocity of the downward movement of the charge in the direction of the diameter of the furnace or in the direction of the height of the furnace, or the velocity of the downward movement of the charges at a preset position, is in excess of the preset standard value, to put it otherwise, the ore-to-coke ratio to be applied in the case of charging the same into the furnace through the top thereof is reduced to a lower level, thereby properly controlling the conditions of the furnace heating on a constant level. Because, in case the velocity of the downward movement of the charges should increase, in spite that the conditions of the blow including the quantity of the air to be blown into the furnace through the tuyere 9 formed in the lower portion thereof is kept constant, heat exchange between the charges and such gases as rise in the space of the furnace, and reduction of the iron ore by carbon monoxide and hydrogen, fall short in terms of the level thereof, to thus result in lowering of the furnace heating level. And, the other objective of the control of the charge is to improve the distribution of the charges. To put it in concrete terms, in the case of such a blast furnace as is provided with no such charge distribution control device as the well-known movable armor or the like, charge control plays an important role as a charge distribution control means. In other words, for the reason that the angle of inclination of coke is generally smaller than the angle of inclination of iron ore, in the interior of a blast furnace, as set forth above, a change in the quantity of coke to be charged each time through the top of the furnace (hereinafter referred to as the coke base) results in causing the distribution of the thickness of the layers of the charges in the direction of the diameter of the furnace to be subjected to a change, even in case the ore-to-coke ratio remains the same. Because, coke is small in terms of the angle of inclination, hence apt to flow in the direction of the center of the furnace, while ore is rather large in terms of the angle of inclination, hence prone to be deposited in the vicinity of the wall of the furnace. Therefore, when the coke base is small, the quantity of the coke and that of the iron ore to be charged each time are small accordingly, wherefrom mainly coke is charged into the center of the furnace, and mainly ore is charged in the portion in the vicinity of the wall of the furnace, to the contrary, which results in improving the permeability in the vicinity of the center of the furnace, and reducing the flow of gases in the vicinity of the wall of the furnace. In the meantime, when the coke base is enlarged, the quantity of the coke to be deposited in the vicinity of the wall of the furnace increases, though the relative trend remains unchanged, and the quantity of the ore to flow in the direction of the center of the furnace increases, to the contrary, which tends to uniformalize the distribution of the thickness of the layers in the direction of the radius. For such a reason as is set forth above, in case the distribution of the thickness of the layers of the charges in the direction of the radius in the furnace is properly detected, such a method as controls the charge of ore or coke is adopted for the purpose of so controlling the said distribution of the thickness of the layers as to be in conformity with the preset standard value. By the bye, the above-mentioned movable armor and the like are what are specifically designed for conducting direct control of the position of drop of the ore and the coke to be charged from the top of the furnace in the radial direction, and it goes without saying that the movable armor constitutes a quite useful means for effecting the control of the distribution of the thickness of the layers of the charges set forth above.

Next, with regard to the control of the blow, in case the velocity of the downward movement found in the form of a mean value through the said distribution of the velocity of the downward movement of the charges, or the velocity of the downward movement of the charges at the setting position thereof, should be in excess of the preset standard value, it is practicable to reduce the velocity of the downward movement, to put it otherwise, to conduct proper control of the blow, either by reducing the quantity of the blow or the flow of oxygen, or by increasing the flow of heavy oil, and thereby the condition of furnace heating can be maintained on a constant level. Besides, it goes without saying that the same effect as that set forth above can be attained likewise by the employment of a proper means of the blow control, including the control of the temperature of the blow and the control of the humidity of the blow. Furthermore, in case the distribution of the thickness of the layers of the charges or the distribution of the shape of the charges, in the direction of the radius, should lack uniformity, the quantity of the blow and/or the flow of oxygen are/is required to be modified in some case, for the purpose of making not uniform the distribution of resistance to permeability to air in the radial direction in the furnace as well. For instance, in case the quantity of coke present at the center of the furnace is large, and the flow of gases in the furnace is concentrated in the vicinity of the center of the furnace, the velocity of the flow of gases in the furnace can be lowered by the application of a proper method of either reducing the quantity of the blow and so forth or elevating the undermentioned pressure at the top of the furnace, whereby the distribution of the flow of gases in the radial direction can be so rendered as to be uniform. Lastly, with regard to the control of the pressure at the top of the furnace, such an effect as is basically analogous to the said control of the blow can be expected thereof. To put it in concrete terms, in case the distribution of the thickness of the layers of the charges or the distribution of the shape of the charges, in the radial direction, is not uniform, or in case a considerable difference from the preset standard value is found to be present, the pressure at the top of the furnace is to be increased for the purpose of uniformalizing the distribution of the velocity of the flow of gases in the radial direction, whereby the velocity of the wind at the tuyere, as well as the velocity of the flow of gases in the furnace, can be reduced. Thereby the reducing efficiency of ore by the reducing gas present in the furnace is increased, and not only the permeability can be improved but also fuel cost can be reduced. On the contrary, in case the flow of gases in the vicinity of the center of the furnace is required to be accelerated, the flow of gases of the said category whereof the resistance to permeation to air is basically small can be properly accelerated either by lowering the said pressure at the top of the furnace or by increasing the said quantity of the blow.

Figure 16:
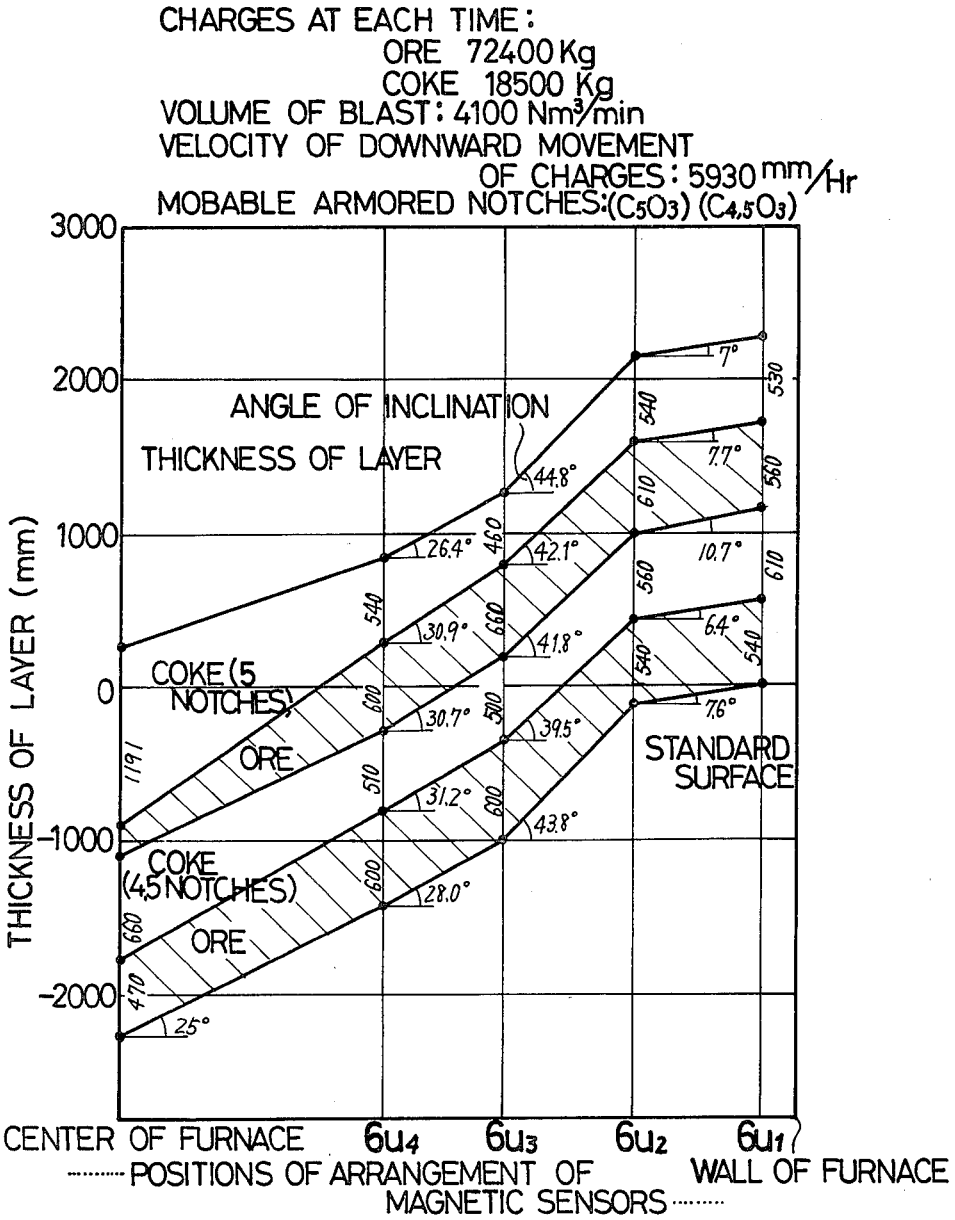
FIG. 16 is a drawing showing other results of working of the operating system introduced in the present invention.

Shown in FIG. 16 is an example of the result of detection of the distribution of the thickness of the layers of ore 2 and coke 3, and the distribution of the shape thereof, in the filling layers of the charges in the furnace, that could be obtained by conducting the above-mentioned processing of the output signals from as many as four magnetic sensors $6u_1$–$6u_4$ through the signal processing unit, in such a case wherein the said four magnetic sensors $6u_1$–$6u_4$ are fixed and fitted in place, with spacings of 890 mm in the direction of the diameter of the furnace, in the interior of such a hollow tube 4 as is arranged 4,100 mm below the stock line (usually termed S.L. in an abbreviated form, and designating the horizontal surface 1 m below the lower end of a large bell 20 set in place at the time of the downward movement of the charges) of the blast furnace of 2,800 $m^3$ in internal volume. In the drawing, the longitudinal axes represent such a series of height of layers, distance, or thickness of layers measured by the magnetic sensor $6u_1$ at the time of taking the lower end surface of the standard layer of ore 2 as a criterion thereof, and the transversal axes represent the positions of arrangement of the magnetic snesors $6u_1$–$6u_4$ fitted in place in the direction of the radius of the furnace.

In the case of this illustration, obtained were results of the measurement conducted under such conditions that the charges through the top of the furnace were 72.4 tons of ore and 18.5 tons of coke each time, and, the conditions of the armored notch control by a movable armor were such that forming of 5 notches and forming of 4.5 notches were conducted in an alternate manner at the time of charging of coke, while forming of notches at the time of charging of ore was so controlled as to be 3 notches. Now, the reults of the measurement reveal that the more the number of notches is, the nearer to the center of the furnace the charges were to be charged. Therefore, it is revealed that, under the working conditions shown in the drawing, emphasis was placed, throughout the working, on such points that coke 3 was charged nearer to the center of the furnace than ore 2 was, that the layer of the coke was given more thickness at the center of the furnace in a relative manner, and that the layer of the ore was given more thickness in the vicinity of the wall of the furnace than the layer of coke was. Besides, in the case of this illustration, fitting of the hollow tube 4 on the body of the furnace 1 was effected only on a single stage in the direction of the height of the furnace; therefore, the velocity of the downward movement of the charges selected for use was of such a level as 5,930 mm/Hr that had been calculated in advance on the basis of the indication on the said sounding level meter.

And, in FIG. 16, the hatched portion represents the layer of ore 2, and the blank portion represents the layer of coke 3. In the drawing, the case wherein the coke is of 5 notches, and the case wherein the coke is of 4.5 notches, are respectively indicated in a separate manner, which is attributable to such a manner that only such data as are related only to the coke 3 charged with 5 notches, for one thing, formed thereon were subjected to integration or averaging treatment, to thus find the distribution of the thickness of the layer and the angle of inclination (the distribution of the shape) of the 5-notch coke 3, on the basis of the signals from the respective magnetic multi-sensors $6u_1$–$6u_4$ within the period of approximately 4 hours, so also found in this case were the distribution of the thickness of the layer and the angle of inclination of the coke 3 charged into the furnace, with 4.5 notches formed thereon, and by the application of the same method. Besides, the results of calculation of the thickness of the layers and the angle of inclination of the ore 2 and the coke 3 measured at the respective measuring points are also made entry in the drawing; however, it has been confirmed clearly and distinctly enough that such a slight change in the armored notches by only as little as 0.5 notch at the time of charging of the coke results in a considerable change in the distribution of the thickness of the layers and the angle of inclination (distribution of the shape) of the charges in the direction of the diameter of the furnace or in the direction of the height of the furnace, furthermore, the distribution of the shape in the direction of the diameter of the furnace is not linear, the inclination is sharp at an intermediate portion slightly away from the wall of the furnace, and the inclination is gentle in the vicinity of the wall of the furnace and at the center of the furnace.

What is claimed is:

1. A furnace operating apparatus for a blast furnace, comprising:

at least two hollow tubes extending within the furnace and below a raw material charging level such that said hollow tubes are surrounded by the charges, each hollow tube containing at least one magnetic sensor within the tube for detecting changes in the magnetic vector of the magnetic field generated in the vicinity of each sensor, caused by the downward movement of the charges; and signal processing means electrically connected to said magnetic sensors for receiving signals from the magnetic sensors for detecting the filling conditions of the charges.

2. An apparatus as in claim 1, wherein said hollow tubes are separated from each other in a vertical direction along the height of the furnace.

3. An apparatus as in claim 1, wherein a plurality of said hollow tubes are placed in a substantially common vertical plane within a vertical direction of the furnace.

4. An apparatus as in claim 1, wherein each hollow tube comprises a double tube including an inner hollow tube and an outer tube, said magnetic sensors being provided within said inner hollow tubes.

5. An apparatus as in claim 1, wherein each hollow tube comprises a quenching medium circulating system.

6. An apparatus as in claim 1, wherein said magnetic sensors are movable within the hollow tubes.

7. An apparatus as in claim 1, wherein said magnetic sensors are fixed within the hollow tubes.

8. An apparatus as in claim 1, wherein said hollow tubes are coupled together to form a unitary complex tube unit.

9. An apparatus as in claim 1, wherein each of said magnetic sensors comprise an exciting section and a magnetism detecting section, said exciting section producing an exciting magnetic field, said detecting section detecting the changes in the vector component along a detecting axis direction in which the magnitude of the exciting magnetic field changes responsive to the downward movement of the charges.

10. A method for controlling the filling conditions of raw material charges within a blast furnace, comprising the steps of:

placing at least two hollow tubes into the furnace and extending within the furnace below the raw material charging level in a manner that the hollow tubes are surrounded by the charges, positioning at least one magnetic sensor into each hollow tube for detecting the changes in the magnetic vector of the magnetic field generated in the vicinity of each sensor by the downward movement of the charges;

coupling output signals from the magnetic sensors to a signaling processing unit to detect the filling conditions of the charges, and controlling the operation of the blast furnace responsive to the detected filling conditions to obtain a predetermined desired filling condition.

11. A method as in claim 10, further comprising the steps of:

providing at least two of the hollow tubes vertically spaced above each other in the furnace with their respective magnetic sensors also vertically spaced from each other;

determining the time difference between the occurrence of the output signals from the vertically spaced magnetic sensors; and calculating the downward moving velocity of the charges by dividing the vertical distance between the magnetic sensors by the detected time difference.

12. A method as in claim 10, further comprising the steps of:

providing at least two of the hollow tubes spaced from each other along a radial direction of the furnace, with each hollow tube containing at least one magnetic sensor;

detecting the time difference between the occurrence of the output signals from said radially separated magnetic sensors;

calculating the downward moving velocity of the charges by dividing the distance between the magnetic sensors by the detected time difference; and detecting the shape distribution in the radial direction of the furnace by using as inputs to the signal processing unit, the detected time difference, the calculated downward moving velocity, and the distance between the radially separated magnetic sensors.

13. A method as in claim 10, further comprising the steps of:

providing at least two of the hollow tubes spaced from each other in the furnace along a vertical direction, each tube including at least one magnetic sensor therein;

detecting the time difference between the occurrence of the output signals from said vertically separated magnetic sensors;

calculating the downward moving velocity of the charges by dividing the distance between the magnetic sensors by the detected time difference; and detecting the shape distribution of the charges in the vertical direction of the furnace from the detected time difference, the calculated downward moving velocity of the charges, and the vertical distance between said magnetic sensors.

14. A method as in claim 10, wherein said step of controlling further comprises adjusting the charging amount of the charges to control the charge layer's thickness distribution and the shape distribution of the charges.

15. A method as in claim 10, wherein said step of controlling further comprises adjusting the downward moving velocity of the charges.

16. A method as in claim 10, wherein said step of controlling further comprises regulating the position to which the charges fall to thereby adjust the charge layer's thickness distribution.

17. A method as in claim 10, wherein said step of controlling further comprises adjusting the pressure at the top of the furnace to adjust the charge layer's thickness distribution.

18. A method as in claim 11, wherein said time difference is determined from times at which respective peak values appear in the output signals of the vertically spaced magnetic sensors.

19. A method as in claim 11, wherein said time difference is determined by calculating the time deflection which enables a cross correlation coefficient of the output signals from the vertically separated magnetic sensors to have a maximum value.

20. A method as in claim 11, further comprising the step of detecting a charge layer's thickness distribution by applying as inputs to said signal processing unit, the calculated downward moving velocity and the time period between which a positive peak value and a negative peak value appear, respectively, in the output signals from at least one magnetic sensor, said time period representing a time interval required for the layer to pass said magnetic sensor.

21. A method as in claim 12, further comprising, changing the charging amount of the charges from that used in a normal charging operation to thereby form a particular pattern in the output signals of said magnetic sensors and to form a boundary surface in the charges for the determination of the shape distribution of the charges.

22. A method as in claim 13, further comprising changing the charging amount of the charges from that used in a normal charging operation to thereby form a particular pattern in the output signals of said magnetic sensors and to form a boundary surface in the charges for the determination of the shape distribution of the charges.

* * * * *